US010384752B2

(12) United States Patent
Reid et al.

(10) Patent No.: US 10,384,752 B2
(45) Date of Patent: Aug. 20, 2019

(54) UNDERWATER VEHICLE DOCKING SYSTEM

(71) Applicant: Seabed Geosolutions B.V., Leidschendam (NL)

(72) Inventors: Brendan James Reid, Maylands (AU); Benjamin Jeremy Ash, Lynwood (AU)

(73) Assignee: Seabed Geosolutions B.V., Leidschendam (NL)

( * ) Notice: Subject to any disclaimer, the term of this patent is extended or adjusted under 35 U.S.C. 154(b) by 0 days.

(21) Appl. No.: 15/836,734

(22) Filed: Dec. 8, 2017

(65) Prior Publication Data

US 2018/0162503 A1 Jun. 14, 2018

Related U.S. Application Data

(60) Provisional application No. 62/432,199, filed on Dec. 9, 2016.

(51) Int. Cl.
*B63G 8/00* (2006.01)

(52) U.S. Cl.
CPC ..... *B63G 8/001* (2013.01); *B63G 8/00* (2013.01); *B63B 2211/02* (2013.01); *B63G 2008/007* (2013.01); *B63G 2008/008* (2013.01)

(58) Field of Classification Search
CPC ..... B63C 11/00; B63C 11/42; B63G 8/00; B63G 8/001; B63G 8/41; B63G 8/42; B63G 8/08
USPC ..... 114/312, 322; 405/185, 188, 189
See application file for complete search history.

(56) References Cited

U.S. PATENT DOCUMENTS 6,167,831 B1 * 1/2001 Watt ..... B63G 8/001 114/322
6,390,012 B1 * 5/2002 Watt ..... B63G 8/001 114/322
6,975,560 B2 12/2005 Berg et al.
7,000,560 B2 * 2/2006 Wingett ..... B63G 8/001 114/322
7,210,556 B2 5/2007 Bath et al.
(Continued)

OTHER PUBLICATIONS

Klaas Koster et al., "Mitigating drilling hazards in the North Sea using ocean-bottom seismic", World Oil, Jul. 1, 2011, XP055183765.

*Primary Examiner* — Lars A Olson
(74) *Attorney, Agent, or Firm* — Park, Vaughan, Fleming & Dowler LLP; Shane Nelson

(57) ABSTRACT

Apparatuses, systems, and methods for the docking of an underwater vehicle (such as a ROV) to a subsea structure (such as a basket or cage) for the transfer of payload devices, such as ocean bottom seismic nodes. The ROV may have a docking probe that is rotatable between an extended and retracted position by a rotatory actuator. The subsea structure may have a docking receptacle that receives the docking probe while the probe is in an extended position. The docking probe and receptacle can latch and/or be secured together by a variety of mechanisms. Once secured, the docking probe can rotate thereby changing the relative positions (horizontal and/or vertical) of the ROV and the subsea structure. The underwater vehicle may have an elevator mechanism that may move vertically and/or horizontally and that is coupled to a handler or grabber for handling and/or transfer of the payload devices.

18 Claims, 10 Drawing Sheets

(56) References Cited

U.S. PATENT DOCUMENTS

| | | | | |
|---|---|---|---|---|
| 7,324,406 | B2 | 1/2008 | Berg | |
| 7,632,043 | B2 | 12/2009 | Thompson et al. | |
| 7,854,569 | B1 * | 12/2010 | Stenson | B63G 8/001 114/322 |
| 8,186,295 | B2 * | 5/2012 | Fournier | B63G 8/42 114/332 |
| 8,310,899 | B2 | 11/2012 | Woodard, Jr. et al. | |
| 8,611,181 | B2 | 12/2013 | Woodard, Jr. et al. | |
| 9,090,319 | B2 | 7/2015 | Brizard et al. | |
| 9,415,848 | B2 | 8/2016 | Jewell | |
| 2006/0159524 | A1 | 7/2006 | Thompson et al. | |
| 2011/0217123 | A1 | 9/2011 | Jewell et al. | |
| 2015/0284060 | A1 | 10/2015 | Jewell et al. | |
| 2016/0121983 | A1 | 5/2016 | Rokkan et al. | |

* cited by examiner

UNDERWATER VEHICLE DOCKING SYSTEM

PRIORITY

This application claims priority to U.S. provisional patent application No. 62/432,199, filed on Dec. 9, 2016, the entire content of which is incorporated herein by reference.

BACKGROUND OF THE INVENTION

Field of the Invention

This invention relates to the use of underwater vehicles and more particularly relates to the docking of a remotely operated vehicle (ROV) or similar underwater vehicle to a subsea basket or cage for the transfer of subsea equipment, such as ocean bottom seismic nodes.

Description of the Related Art

Marine seismic data acquisition and processing generates a profile (image) of a geophysical structure under the seafloor. Reflection seismology is a method of geophysical exploration to determine the properties of the Earth's subsurface, which is especially helpful in determining an accurate location of oil and gas reservoirs or any targeted features. Marine reflection seismology is based on using a controlled source of energy (typically acoustic energy) that sends the energy through seawater and subsurface geologic formations. The transmitted acoustic energy propagates downwardly through the subsurface as acoustic waves, also referred to as seismic waves or signals. By measuring the time it takes for the reflections or refractions to come back to seismic receivers (also known as seismic data recorders or nodes), it is possible to evaluate the depth of features causing such reflections. These features may be associated with subterranean hydrocarbon deposits or other geological structures of interest.

In general, either ocean bottom cables (OBC) or ocean bottom nodes (OBN) are placed on the seabed. For OBC systems, a cable is placed on the seabed by a surface vessel and may include a large number of seismic sensors, typically connected every 25 or 50 meters into the cable. The cable provides support to the sensors, and acts as a transmission medium for power to the sensors and data received from the sensors. One such commercial system is offered by Sercel under the name SeaRay®. Regarding OBN systems, and as compared to seismic streamers and OBC systems, OBN systems have nodes that are discrete, autonomous units (no direct connection to other nodes or to the marine vessel) where data is stored and recorded during a seismic survey. One such OBN system is offered by the Applicant under the name Trilobit®. For OBN systems, seismic data recorders are placed directly on the ocean bottom by a variety of mechanisms, including by the use of one or more of Autonomous Underwater Vehicles (AUVs), Remotely Operated Vehicles (ROVs), by dropping or diving from a surface or subsurface vessel, or by attaching autonomous nodes to a cable that is deployed behind a marine vessel.

Autonomous ocean bottom nodes are independent seismometers, and in a typical application they may be self-contained units comprising a housing, frame, skeleton, or shell that includes various internal components such as geophone and hydrophone sensors, a data recording unit, a reference clock for time synchronization, and a power source. The power sources are typically battery-powered, and in some instances the batteries are rechargeable. In operation, the nodes remain on the seafloor for an extended period of time. Once the data recorders are retrieved, the data is downloaded and batteries may be replaced or recharged in preparation of the next deployment. Various designs of ocean bottom autonomous nodes are well known in the art. See, e.g., U.S. Pat. No. 9,523,780 (citing patents and publications), incorporated herein by reference. Still further, the autonomous seismic nodes may integrated with an AUV such that the AUV, at some point subsea, may either travel to or from the seabed at a predetermined position. See, e.g., U.S. Pat. No. 9,090,319, incorporated herein by reference. In general, the basic structure and operation of an autonomous seismic node and a seismic AUV is well known to those of ordinary skill.

Marine seismic surveys need a fast and cost-effective system for deploying and recovering autonomous seismic receivers that are configured to operate underwater. One conventional method (as illustrated in FIG. 1) is to deploy a ROV in a body of water while also deploying a separate underwater node transfer device, such as a cage or basket or skid, that is configured to hold a plurality of seismic nodes and be lowered and raised from a surface vessel. At a certain subsea position, the ROV docks or mates with the node transfer device and transfers one or more nodes from the node transfer device to the ROV. The ROV then places the retrieved nodes at one or more positions on the seabed. Prior art patents and publications illustrating this option include at least the following: U.S. Pat. Nos. 6,975,560; 7,210,556; 7,324,406; 7,632,043; 8,310,899; 8,611,181; 9,415,848, and U.S. Patent Application Publication Nos. 2006/0159524; 2015/0284060; 2016/0121983, each of which is incorporated herein by reference.

The prior art systems for retrieving seismic nodes from an underwater skid or basket are problematic. Prior art devices are difficult to couple the ROV to the basket, particularly when they are docking at a position in the sea above the seabed when the basket is moving. Prior art systems are difficult to transfer the seismic nodes from the basket to the ROV. Further, prior art systems are limited in the shape and size of nodes that can be deployed by the basket and carried/transferred by the ROV.

A need exists for an improved method and system for deploying and retrieving subsea equipment from a surface vessel to a subsea position on or near the bottom of the ocean. A need exists for an improved seismic node handling system on a ROV. A need exists for an improved docking arrangement between two subsea devices, such as a ROV and basket. A need exists for an improved underwater cage or basket that is able to hold a plurality of autonomous seismic nodes and transfer seismic nodes to the ROV. A need exists for an improved system for a ROV and basket to dock at a subsea position.

SUMMARY OF THE INVENTION

Apparatuses, systems, and methods for the docking of an underwater vehicle (such as a ROV) to a subsea structure (such as a basket or cage) for the transfer of payload devices, such as ocean bottom seismic nodes. The ROV may have a docking probe that is rotatable between an extended and retracted position by a rotatory actuator. The subsea structure may have a docking receptacle that receives the docking probe while in an extended position. The docking probe and receptacle can latch and/or be secured together by a variety of mechanisms. Once secured, the docking probe can rotate thereby changing the relative positions (horizontal and/or vertical) of the ROV and the subsea structure. The underwater vehicle may have an elevator mechanism that may move vertically and/or horizontally and that is coupled to a handler or grabber for handling and/or transfer of the payload devices.

In one embodiment, disclosed is a subsea docking system or apparatus that comprises a rotatable docking probe located on an underwater vehicle that is configured to couple with a docking receptacle located on a second subsea device. The docking probe may be coupled to a rotary actuator and may rotate around a fixed axis point. The docking probe may comprise a tapered end and a slotted groove for coupling with the docking receptacle. The rotatable docking probe is configured to move between a retracted position and an extended position by rotation of the docking probe. The rotation may be continuous or at fixed positions. The retracted position may be substantially upright (such as for during general subsea travel) and the extended position may be substantially horizontal (such as for docking purposes). The docking probe may be at least partially rotated after coupling to move the relative positions of the underwater vehicle and subsea structure. The docking probe may comprise a latching system for coupling with a docking receptacle on the subsea structure. The latching system may be extended and/or actuated by a hydraulic cylinder. For example, a retractable hydraulic cylinder may be actuated for opening and closing a latch around a pin of the docking receptacle. The docking probe may have and/or be coupled to a plurality of other devices, such as a camera located in an eye or opening of the docking probe and one or more sensors.

In one embodiment, disclosed is a subsea docking system that comprises a rotatable docking probe located on a first subsea device and a docking receptacle located on a second subsea device. The docking receptacle is configured to couple with the rotatable docking probe. A distance between the first subsea device and the second subsea device is changeable based on a rotation of the docking probe after the docking receptacle and docking probe have coupled. The docking receptacle may comprise a latching pin and the rotatable docking probe may comprise a latching system that attaches to the latching pin. Other latching and/or securing mechanisms are possible between the docking probe and the docking receptacle. The first subsea device may be an underwater vehicle and the second subsea device may be a node transfer device configured to hold a plurality of seismic nodes. In such an embodiment, the plurality of seismic nodes may be secured to the node transfer device by a latching system that securely attaches to at least one attachment point on each of the plurality of seismic nodes. The system may further comprise a plurality of secondary alignment guides on the first subsea device or the second subsea device to facilitate coupling of the first and second subsea devices. The system may further comprise an elevator mechanism located on the first subsea device (such as an underwater vehicle) that is configured to move up and down. One or more device grabbers and/or handlers may be coupled to the elevator mechanism to facilitate transfer or handling of any payload devices (such as seismic nodes) to and from the first subsea device.

In one embodiment is disclosed a method for subsea docking and/or transfer, comprising coupling an underwater vehicle to a subsea structure with a docking probe and positioning the subsea structure relative to the underwater vehicle by rotation of the docking probe. The underwater vehicle may be an ROV and the subsea structure may be a node transfer device configured to hold a plurality of seismic nodes. The docking probe may be located on the underwater vehicle or the subsea structure. For example, a docking probe may be located on the underwater vehicle and a docking receptacle may be located on the subsea structure. The method may further comprise aligning the underwater vehicle and the subsea structure by a docking guide located on either the underwater vehicle or the subsea structure. The positioning step may include moving the subsea structure vertically and horizontally relative to the underwater vehicle. The coupling step may comprise rotating the docking probe from a retracted position to an extended position and inserting the docking probe into a docking receptacle. The method may further comprise transferring a plurality of payload devices between the subsea structure and the underwater vehicle.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Various features and advantageous details are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. The following detailed description does not limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

Figure 1:
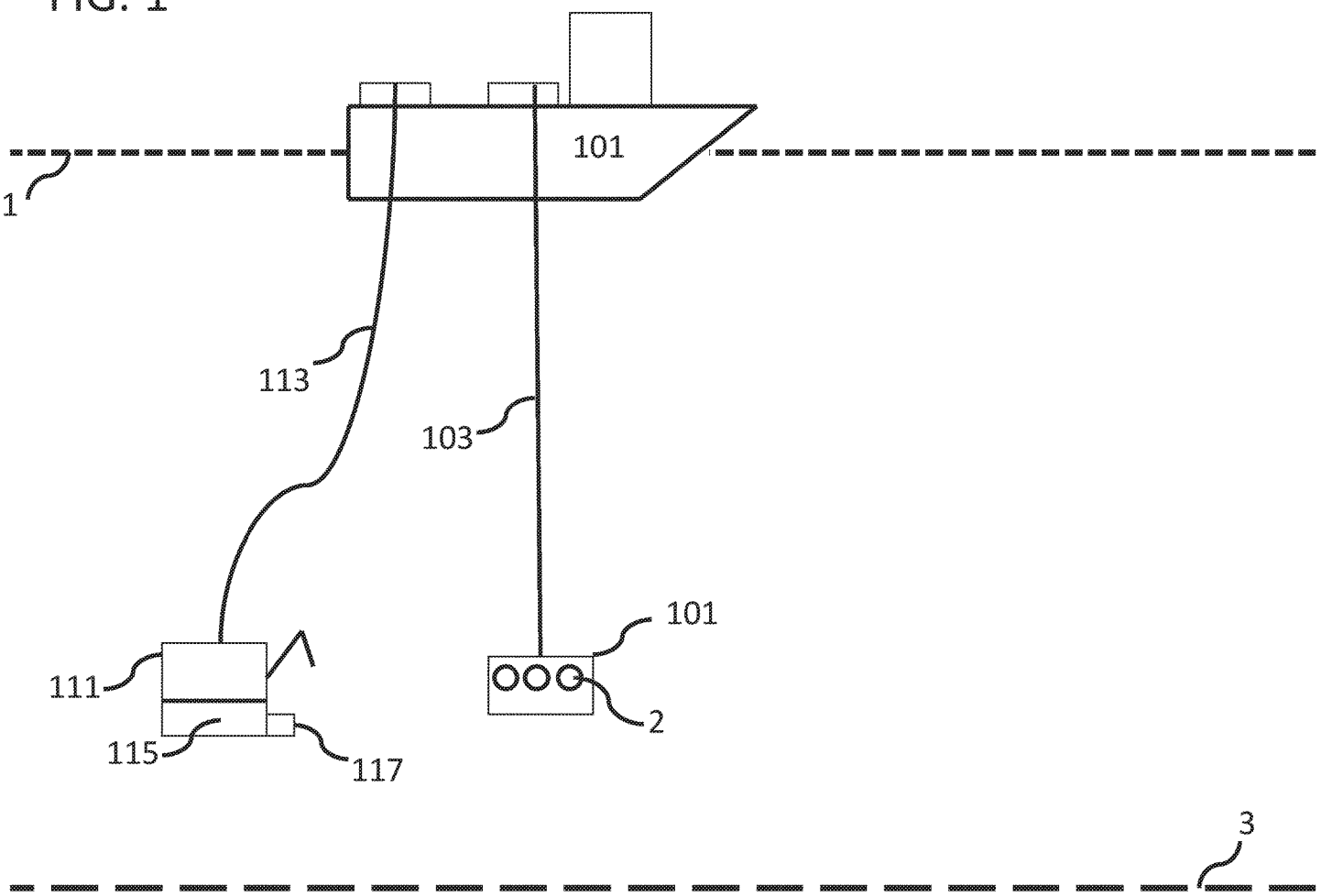
FIG. 1 illustrates one embodiment of a deployment system from a marine vessel using a ROV and subsea basket.

FIG. 1 shows one embodiment of the present disclosure. Seismic devices, such as autonomous seismic nodes, may be lowered from a marine surface vessel to a subsea position for transferring of those nodes to an unmanned underwater vehicle (UUV), such as a remotely operated vehicle (ROV). ROV 111 may be deployed from surface vessel 101 from the surface of a water body, such as sea surface 1. The ROV may be coupled to the surface vessel while in the water via deployment line 113, such as a tether, cable, wire, or rope, as is known in the prior art. Surface vessel 101 is shown in a simplified version in FIG. 1, and one of skill in the art will realize that many more components may be located on the back deck of the vessel for standard vessel operations. For example, one or more launch and recovery systems (LARS) may be located on the back deck of the vessel, which is used to deploy and recover the ROV. While not illustrated for simplicity purposes, for some types of subsea equipment (such as an ROV), deployment line 113 may consist of separate sections, such as a tether section and an umbilical section. For example, as is known in the art, if subsea equipment 111 is an ROV (such as the FUGRO FCV3000 or other similar ROV), the ROV is coupled to a tether management system (TMS) via a first wire segment (or tether) and the TMS is connected to the surface vessel via a second wire segment (such as an umbilical cable). In general, for the purposes of this disclosure, some or all of the portions of an ROV's tether and/or umbilical cable (or other similar subsea device) may be generally considered as the ROV's deployment line. In other embodiments, an autonomous underwater vehicle (AUV) or other UUV may be used instead of an ROV.

In one embodiment, the ROV may have a skid or other payload storage system 115 for storing one or more payload devices and/or for transferring such payload devices from the subsea basket 101 to the ROV 111. For example, skid 115 may comprise or be coupled to docking system 117 for docking and/or coupling ROV 111 to subsea basket 101, which may or may not have a corresponding collar or docking mechanism to mate with the docking system of the ROV. Skid 115 may be located on an underside of the ROV (as shown in FIG. 1) and/or may be partially located on a front, back, or side portion of the ROV. In some embodiments, seismic nodes 2 may be stored and/or handled by a plurality of grabbers, grippers, manipulators, or other single node handling devices (including conveyors, trays, and other seismic transfer mechanisms), as described herein, which may be located within and/or coupled to skid 115. Thus, a wide variety of ROVs may be used with the docking system of the present disclosure.

Subsea equipment 101 may be lowered from surface vessel 101 via cable/line 103. Subsea equipment 101 may be a cage, basket, skid or any other transfer device capable of holding a plurality of payload units, such as a plurality of ocean bottom autonomous seismic nodes 2 in a body of water and transferring those nodes to an external device, such as an ROV. Node transfer device or other subsea structure 101 may be located near the water surface, at a subsea position between the seabed and the surface, near the seabed, or on the seabed. In one embodiment, the ROV and/or node transfer device may be moving in the body of water with a speed based on movement of the subsea structure, movement of the vessel, and/or current movement. Thus, ROV 111 and subsea basket 101 may mate and/or couple at a position above the seabed while one or both devices are moving. In one embodiment, the ROV and the node transfer device each comprise acoustic modems that are configured to communicate with each other via acoustic communications.

While various ROVs and other subsea devices may be used with the embodiments presented in this disclosure, the present disclosure is not limited to any particular ROV, underwater vehicle, subsea transfer device, or configuration thereof to deploy the autonomous seismic nodes on the seabed. Similarly, while one application of the present disclosure is directed to ROVs and subsea baskets/cages used for seismic node deployment in a body of water (such as ocean bottom seismic nodes placed on the seabed), the present disclosure is not limited to such an application or subsea transfer device, and is generally useful for any docking arrangement between a first subsea device and a second subsea device and for the transfer of one or more payload devices between the first and second subsea devices.

As mentioned above, existing prior art ROV and subsea systems have difficulty effectively and efficiently coupling with a subsea transfer device in a body of water, particularly when both devices are moving. The present disclosure solves prior art docking difficulties in part by utilizing a rotary docking system that may move the ROV and subsea device closer to each other vertically and/or horizontally during and/or after docking, thereby allowing automated loading, unloading, and/or transfer of payload devices with as little relative movement as possible. Further, the present disclosure provides significant improvements on handling payload devices (such as ocean bottom seismic nodes) on the subsea transfer device, transferring those devices between the subsea device and the ROV (such as by an elevator mechanism on the ROV), and handling the subsea devices by the ROV (such as by one or more grippers on a front or end portion of the ROV).

Figure 2:
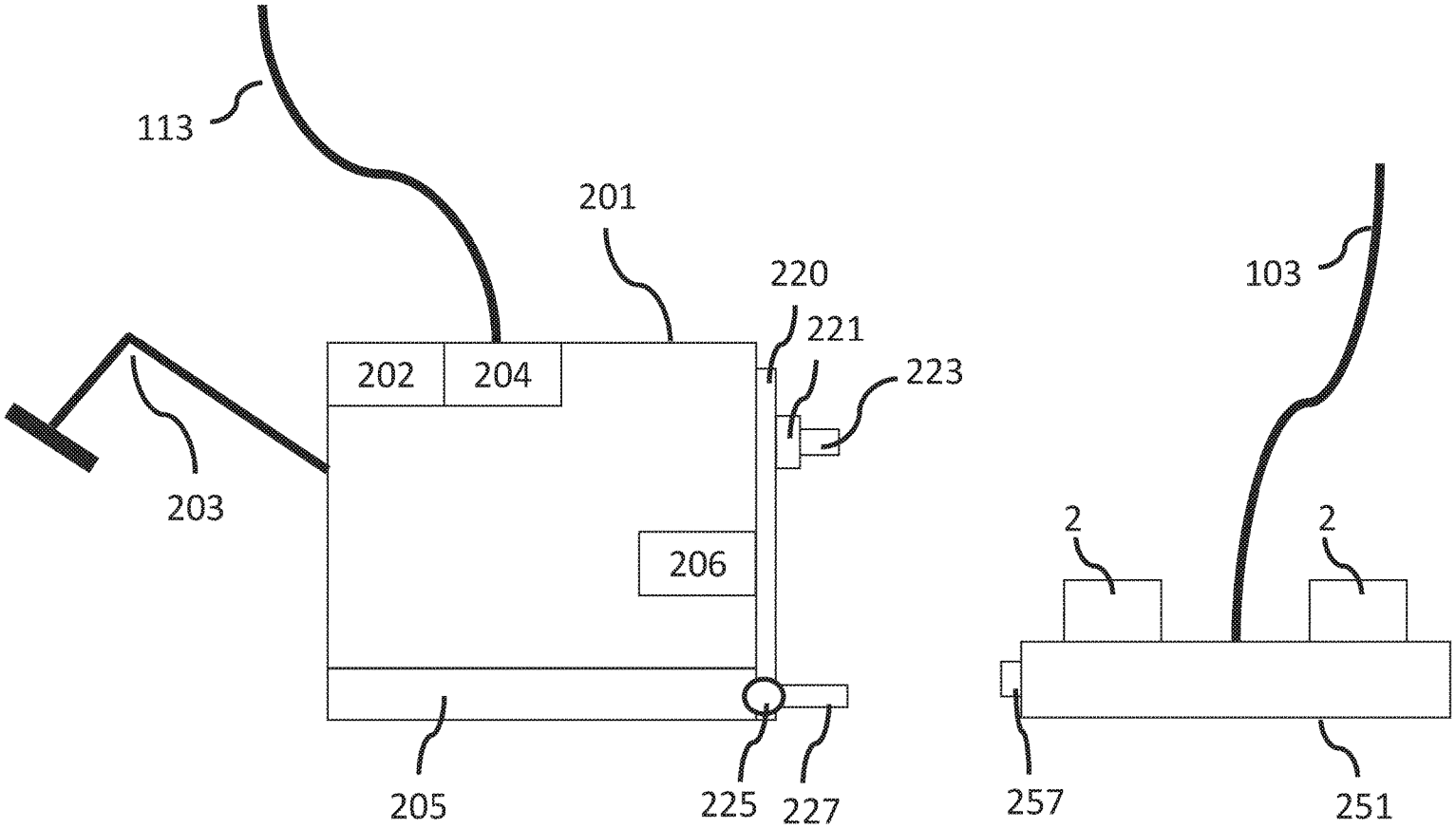
FIG. 2 illustrates one embodiment of a docking system between a ROV and subsea basket.

FIG. 2 illustrates one embodiment of a docking system between a ROV and subsea basket. ROV 201 may be substantially similar to ROV 111 and may comprise a frame with various electrical and mechanical components coupled to the frame. ROV 201 may be coupled to a surface vessel via deployment line (e.g., tether and/or umbilical) 113. As is known in the art, it may have one or more manipulator arms 203 that can help deploy and/or retrieve payload devices (such as ocean bottom seismic nodes) to and from the ROV and be used for general mechanical operations underwater. Also as is known in the art, the ROV may have a propulsion system, cameras, power interfaces, communications and acoustic systems, navigation systems, guidance systems, processors, memory devices, and other electronic components, generically referenced in FIG. 2 by schematic boxes 202, 204, and 206. U.S. Patent Publication No. 2016/0121983, incorporated herein by reference, discusses various ROV systems and features that may be included in ROV 201. The embodiments described in the present application are not particularly dependent on such systems.

ROV 201 may comprise and/or be coupled to docking skid 205, which may be partially located on a lower side of the ROV. Docking skid 205 may be integrally connected to the ROV frame and/or merely coupled to the ROV. In one embodiment, skid 205 is used and configured to store and/or transfer a plurality of seismic nodes 2 (or other payload devices) to and from the ROV. In one embodiment, skid 205 comprises a plurality of levels with slots, trays, or conveyors on which a plurality of nodes can be stored and/or moved. The trays or conveyors may extend partially out from the skid and/or ROV while the seismic nodes are being deployed or retrieved from the ROV.

In other embodiments, skid 205 may not hold seismic nodes within the skid but may be configured to hold the payload devices within one or more attachment mechanisms located on an external portion of ROV 201 or skid 205. For example, ROV 201 or skid 205 may be coupled to ROV node transfer device 220, which may be located on the front or back end of the ROV. The node transfer device 220 facilitates transfer of the seismic nodes to and from the ROV. The node transfer device 220 may be a grid frame on which one or more elevator mechanisms 221 may be able to travel vertically and/or horizontally during handling or transfer of a node (or other payload devices). For example, ROV node transfer device 220 may comprise a plurality of vertical rails or bars that are coupled to portions of ROV 201 and skid 205. Elevator 221 may move up and down along the vertical rails. One or more node handlers 223, such as grabbers, claws, latches, or similar attachment mechanisms, may be coupled to elevator 221 and configured to rigidly couple to a portion of a seismic node for transfer to and from the ROV and for handling of the node during ROV movement. In one embodiment, node handler 223 rotates and/or pivots with respect to the ROV and elevator 221. Thus, elevator mechanism 221 may move vertically along ROV node transfer device 220 and node handler 223 may move vertically and/or horizontally by rotating and/or pivoting once near the node. In some embodiments, a hydraulic or electrically operated latching system may be used to secure the node to the handler/grabber and ROV. In other embodiments, elevator 221 operates as a macro adjustment and node handler 223 operates as a micro adjustment for handling seismic nodes.

Docking probe 227 is configured to dock with a second subsea device, such as subsea basket or skid 251, which may be resting on the seabed or connected to a surface vessel by cable or rope 103 and configured to hold a plurality of payload devices (such as seismic nodes 2) on a surface of or within the skid or basket. Docking probe 227 may be coupled to ROV 201, skid 205, and/or ROV node transfer device 220. In one embodiment, docking probe 227 is located at a lower end of ROV node transfer device 220. Docking probe 227 may be substantially cylindrically shaped with a latching mechanism on one end for engagement with a corresponding receptacle or capture collar 257 on subsea basket 251. The latching mechanism may be remotely operated, such as by electronic or hydraulic pressure. In some embodiments, more than one docking probe may be used. The docking probe may have a fixed length or may have one or more portions that extend out during mating and/or coupling with the subsea basket.

The docking probe may be rotated to engage the transfer device and the ROV, and the rotation may be in a circular, semi-circular, or elliptical shape. The rotation may be continuous or staged, and may rotate between a plurality of different positions between a retracted and extended position. In some embodiments, once transfer device 251 and ROV 201 are coupled and/or otherwise docked together, the two devices may be pulled together (e.g., the distance between the two devices decreased) by a rotation of the docking probe. In some embodiments, the docking probe is located on ROV 201, and in other embodiments the docking probe may be located on node transfer device 251.

Figure 6A:
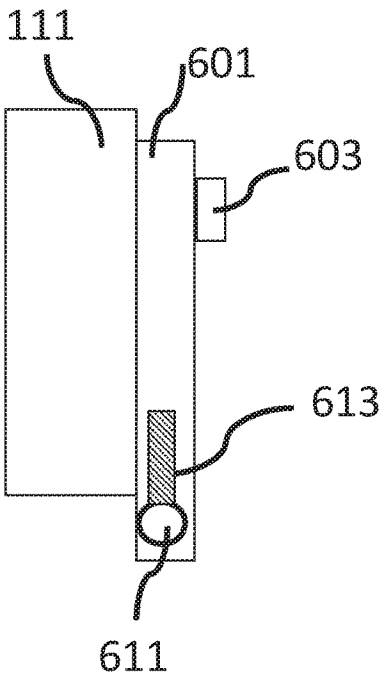
FIGS. 6A-6C illustrate operational steps for docking a ROV to a subsea device using a rotary docking probe according to one embodiment of the present disclosure.
Figure 6B:
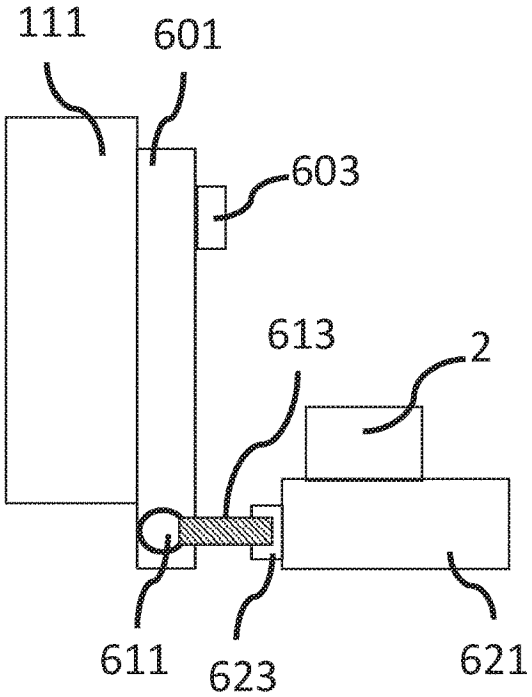
Figure 6C:
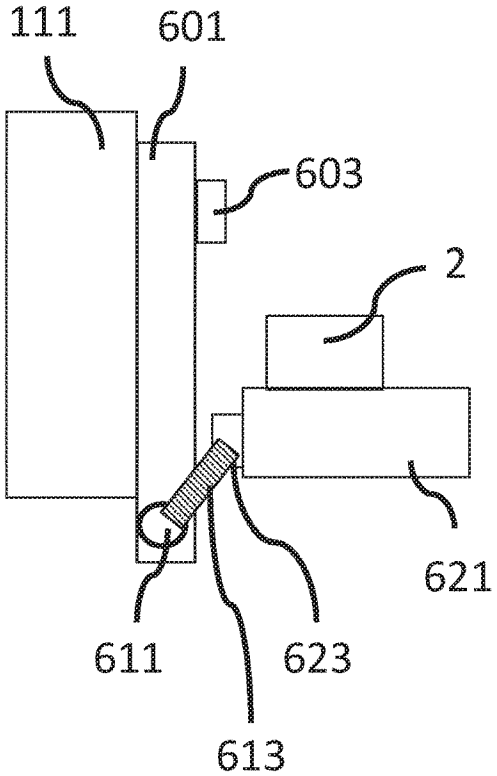

In one embodiment, docking probe 227 may rotate vertically and/or horizontally before, during or after mating with subsea basket 251 by rotary actuator 225. In one embodiment, docking probe 227 may be substantially located within ROV node transfer device 220 in a substantially vertical and/or upright position during general ROV movement (as shown in FIG. 6A). As the ROV approaches a subsea device to couple with, rotator 225 may be actuated to cause docking probe 227 to fully extend into a substantially horizontal or extended position (as shown in FIGS. 2 and 6B). Once mating and/or coupling occurs between the docking probe and the subsea basket, docking probe 227 may be rotated vertically to pull the basket closer to the ROV and to change the elevation of the basket relative to the ROV (as shown in FIG. 6C). Thus, rotation of the docking probe causes a vertical and/or horizontal change in position between the ROV and the subsea basket. This change in position allows the ROV node transfer device to more easily grab, secure, and transfer seismic nodes between the subsea basket and the ROV by eliminating as much relative movement as possible between the ROV and basket. In some embodiments, the docking probe can be rotated clockwise and/or counterclockwise during coupling with a transfer device and/or moving between a retracted and/or extended position.

While not shown in FIG. 2, the ROV may have one or more docking guides for additional alignment during docking. Each of the docking guides may mate or align with portions of the subsea basket. Each docking guide may have one or more notches or grooves (each which may have many shapes, such as triangular, semi-circulator, etc.) to correspond with corresponding rails or devices on the subsea basket. The docking guides may also be coupled to cylinders that are configured to extend and/or retract the docking guides from skid 205 and/or ROV node transfer device 220. Thus, the ROV may generally travel with the docking guides in a retracted position and when the ROV approaches the subsea basket the docking guides (in addition to docking probe 227) may be extended to mate with or attach to the subsea basket. In some embodiments, the docking guides may grab or latch onto the subsea basket and pull the it closer to the ROV for better transferring of the seismic nodes from the basket to the ROV.

Figure 3A:
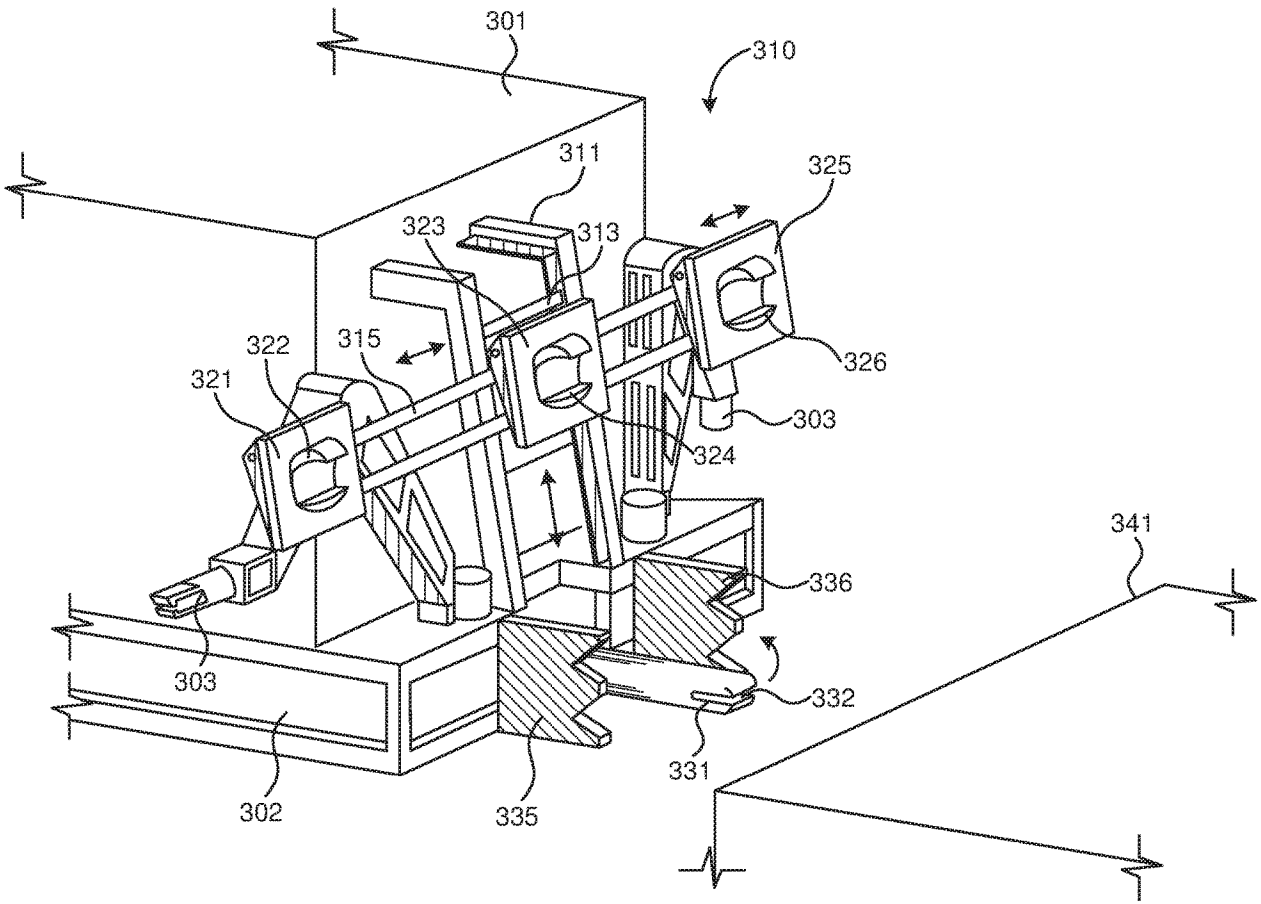
FIG. 3A illustrates one embodiment of a ROV docking system.

FIG. 3A illustrates one embodiment of a ROV docking system. Similar to prior designs, the ROV docking system may comprise ROV 301, skid 302 coupled to an underside portion of the ROV, and docking system 310 (which may be functionally similar to ROV node transfer device 220). ROV 301 and ROV skid 302 are shown in simplified format in FIG. 3A. Transfer skid/basket 341 (also shown in a simplified format in FIG. 3A) is configured to hold a plurality of autonomous seismic nodes (or other subsea payload devices) and dock with the ROV. Docking system 310 may be located on a front or rear portion of the ROV and may comprise a rotatable docking probe 331 (as discussed in more detail in relation to other figures) which may comprise a grooved or slotted end 332 for mating with a corresponding receptacle (not shown) on node transfer device 341. The ROV may also comprise one or more node handlers 321, 323, 325, each configured to handle a node and transfer a node between the node transfer device 341 and ROV 301. A node may be transferred one at a time from node storage device 341 to ROV 301, or a plurality of nodes may be transferred substantially simultaneously from the node storage device to the ROV. The node handlers may also be used to place and recover the seismic nodes to and from a subsea position, such as the seabed. Thus, the nodes, while attached to the ROV, may not be part of a storage compartment or resting on a skid as is typical in most prior art ROV devices. Instead, the nodes may be merely grabbed and/or held onto by a node handler on either the front or rear portion of the ROV. In one embodiment, each node handler comprises a node grabber or latching assembly that secures to a portion of a seismic node for node handling. For example, each node handler 321, 323, 325 may have a claw or grabber 322, 324, 326, respectively, that may be moved between an open and closed position, such as by the use of one or more hydraulic cylinders or other hydraulic actuators. Other securing means may also be used, such as suction cups, latches, etc.

In one embodiment, docking system 310 may comprise frame 311 that is configured to move an elevator mechanism 313 (and any attached node handlers) vertically up and down, such as from a first vertical position to a second vertical position. For example, elevator mechanism 313 may travel along a plurality of vertical rails (not shown) that are coupled to frame 311. In one embodiment, each of the node handlers is configured to rotate, pivot, or angle while still at the substantially same vertical position. In one embodiment, each of the node handlers may move left or right relative to the ROV and/or elevator mechanism by sliding or moving along a track or pair of rails 315. In one embodiment, rails 315 may be coupled to elevator mechanism 311. Thus, a portion of docking system 310 may be actuated to move a plurality of node handlers vertically and/or horizontally as appropriate. In one embodiment, each node grabber may be specifically positioned and aligned to mate with (or grab) a seismic node from the seismic transfer device and remove or replace those nodes off or on the seismic transfer device. In one embodiment, each node handler 322, 324, 326 may hold the node while the ROV moves to a seabed location. The node handlers 321, 323, 325 may vertically move each of the nodes down (relative to the ROV) and the node grabbers opened and/or released to place the node(s) on the seabed. In some instances, one or more arm manipulators 303 may be located on the ROV, ROV skid, and/or docking system 310 to assist in the placement or retrieval of the node from and to the seabed.

Further, in one embodiment ROV 301 may comprise and/or be coupled with one or more secondary docking guides 335, 336 located on either side of docking probe 331 to facilitate alignment and/or docking of the ROV to the node transfer device 341. Docking guides 335, 336 may comprise one or more shapes or recesses to align and/or coupled to corresponding portions of node transfer device 341. The docking guides and/or docking probes may or may not be configured with retractable mechanisms to move the node transfer device towards the ROV (or vice versa).

Figure 3B:
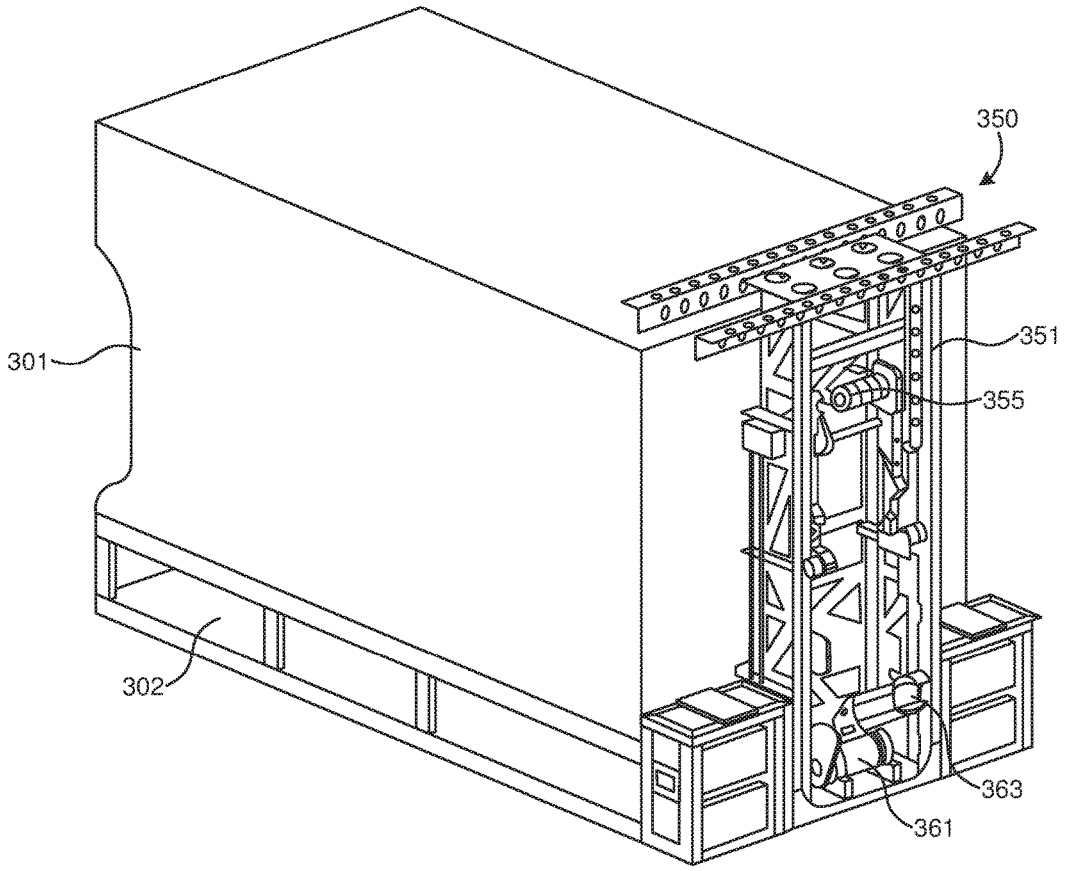
FIG. 3B illustrates another embodiment of a ROV docking system.

FIG. 3B illustrates another embodiment of a ROV docking system. Similar to FIG. 3A, the docking system described in FIG. 3B includes ROV 301 and ROV skid 302 and ROV docking system 350 (which may be similar to ROV node transfer/docking system 220). ROV 301 and ROV skid 302 are shown in simplified format. Not shown is a separate subsea transfer device, such as that illustrated in FIGS. 2 and 3A. In one embodiment, ROV docking system 350 is coupled to a front or rear portion of the ROV. ROV docking system 350 may comprise elevator system 351 to which is attached a node handler 355. The node handler may move up and down elevator system 351 for seismic node handling and transfer to and from the ROV. A wide different number of node grabbing and/or securing devices may be coupled to node handler 355, and depends on the node shape and design and the corresponding attachment mechanism on the node itself. In one embodiment, the node grabber is configured to rotate and/or pivot relative to node handler 355. A single node handler is shown in FIG. 3B, but a plurality of node handlers may be coupled to the elevator system 351 and/or docking system 350. In one embodiment, docking system 350 comprises rotary probe 363, which may be rotated between one or more extended and retracted positions by rotary actuator 361. The rotary probe is used to dock, mate, and/or couple the ROV to a separate subsea device. The rotary probe is discussed in greater detail throughout this disclosure.

Figure 4A:
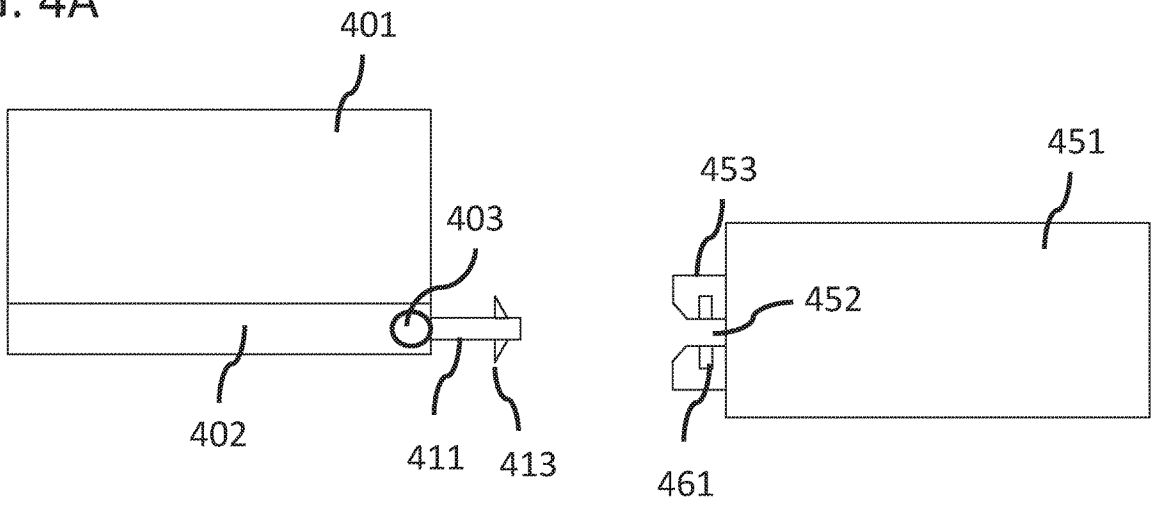
FIG. 4A illustrates one embodiment of a docking system between a ROV and subsea basket.
Figure 4B:
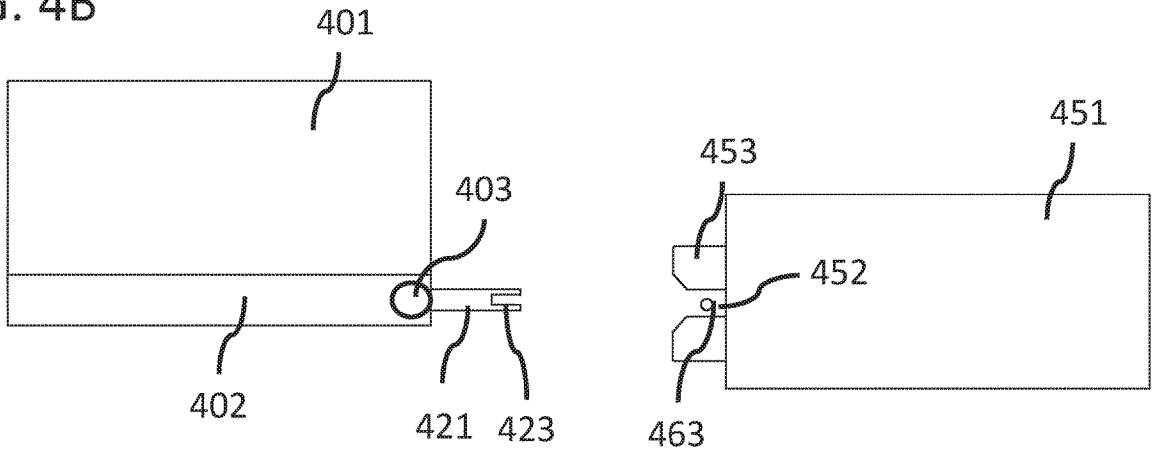
FIG. 4B illustrates another embodiment of a docking system between a ROV and subsea basket.

FIGS. 4A and 4B illustrate embodiments of a docking system between a ROV and subsea basket or other subsea node transfer device. The ROV, skid, and subsea transfer device illustrated in FIGS. 4A and 4B are simplified and used for illustration purposes only, and one of skill in the art will realize that these devices are more complex. FIG. 4A shows a docking probe with hydraulic latches, while FIG. 4B shows a docking probe that latches onto a corresponding pin.

ROV 401 may be coupled to skid 402, which may be located at least partially on a lower side of the ROV frame and a front or back portion of the ROV. The ROV may couple with a skid or basket or other subsea transfer device 451 via a docking probe on the ROV/skid and a docking receptacle 452 on the subsea basket 451. Docking receptacle 452 may have a plurality of plates or guides 453 on an upper, lower, or side of the docking receptacle to facilitate docking of the docking probe into the receptacle. The docking receptacle is configured to mate and/or couple with the docking probe utilized on the ROV. Once the docking probe is secured to the docking receptacle, the docking probe can be rotated by actuator 403 to move the probe at least partially upwards to thereby move the subsea transfer device 451 towards the ROV vertically and/or horizontally. Thus, the docking probe may rotate around a fixed fulcrum point, such as rotary actuator 403. The length of the docking probe may fixed or extendable (such as with an internal hydraulic cylinder), and it can be rotated from a retracted position to an extended position for engagement to separate node transfer device 451. While not shown, the ROV may have one or more grabbers or guides for additional alignment and/or pulling the seismic transfer device to the ROV.

Referring to FIG. 4A, docking probe 411 is coupled to a rotary actuator 403 that moves the probe between a substantially vertical position (not shown) and a substantially horizontal position. Docking probe 411 may be substantially cylindrical or elongated. Docking probe 411 may comprise and/or be coupled with hydraulic latches 413 which may extend out from one or more surfaces of the docking probe, such as near an end of the probe. Docking receptacle 452 may have an opening into which docking probe 411 is inserted and one or more corresponding receptacles 461 for the hydraulic latches 413 to securely engage with and/or couple. Once into the appropriate position, the latches 413 may be extended hydraulically to securely fix within receptacles 461. Thus, in one embodiment, the hydraulic latches may be fully or partially retracted before the docking probe is inserted into the receptacle and once the docking probe has fully entered the receptacle, the hydraulic latches 413 may be further extended to securely latch and/or lock the ROV to the node transfer device.

Referring to FIG. 4B, docking probe 421 is coupled to a rotary actuator 403 that moves the probe between a substantially vertical position (not shown) and a substantially horizontal position, similar to that described in relation to FIG. 4A. Docking probe 421 may be substantially cylindrical or elongated with a slit, notch, opening, or groove 423 on one end of the probe. Docking receptacle 452 may have an opening with latching pin 463 (e.g., a vertical or horizontal bar) over which the probe groove can be inserted and coupled together. In one embodiment, a latching mechanism is located on either the docking receptacle or the docking probe to securely engage with and/or couple the probe and docking receptacle. For example, the docking probe may be equipped with a hydraulic latch (not shown) proximate to the groove 423, and once probe 421 has been inserted around docking pin 463, a latch may be actuated to securely fix the probe 421 around latching pin 463. Other latching and/or securing mechanisms, consistent with the above, may be used with the disclosed rotary docking probe. For example, a vertical latching pin may be used instead of the disclosed horizontal latching pin, with corresponding changes to groove 423 of probe 421.

Figure 5B:
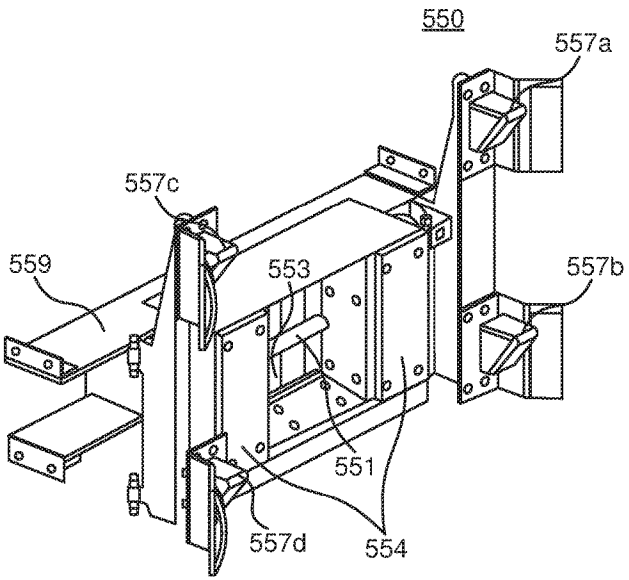
FIG. 5B illustrates one embodiment of a docking receptacle for the docking probe of FIG. 5A.
Figure 5A:
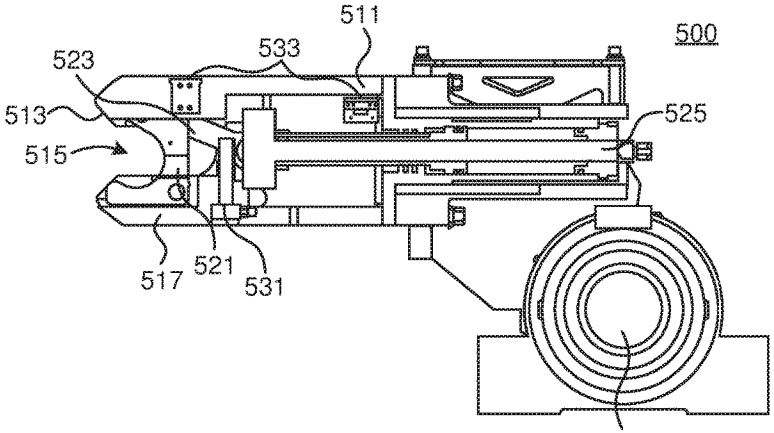
FIG. 5A illustrates one embodiment of a rotary docking probe for a ROV docking system.

FIG. 5A illustrates one embodiment of a rotary docking system for a ROV docking system. Rotary docking system 500 comprises docking probe 511 that rotates around rotary actuator 501. Docking probe may rotate clockwise and/or counterclockwise relative to rotary actuator 501. As is known in the relevant art, the rotary actuator may comprise a plurality of different devices, including mechanical, hydraulic, pneumatic, or electric actuators. The rotation movement may be continuous or stepped between various fixed rotational positions. The rotational speed may be variable. The rotary docking probe may comprise a first end or nose 517 that comprises opening 515 with one or more angled surfaces/edges 513. Probe nose 517 is configured to couple with a corresponding docking receptacle (as shown in FIG. 5B) on a separate subsea device. Opening 515 may be sized to fit around a pin, bar, or shaft in the docking receptacle (not shown). In one embodiment, probe 511 comprises docking latch 521 that is located partially or substantially within opening 515. Docking latch 521 is configured to move between a closed/locked and opened/unlocked position, such as by actuation of connecting rod 523. The connecting rod may be actuated by a spring or other hydraulic actuator 525. One of skill in the art will realize that other latching mechanisms may be utilized for coupling the probe to a subsea device. Probe 511 may also comprise a plurality of sensor devices 533 (such as proximity sensors) to facilitate control over the docking probe operation. In one embodiment, the probe may be equipped with camera 531 located at least partially within an eye of the probe, such as opening 515. Camera 531 may be oriented outwards from the probe to provide a clear and close view of the docking procedure between the probe and the subsea device. Such a view from camera 531 may be displayed to the ROV operator to assist docking, and in some embodiments the signals from camera 531 may be routed to one or more computers for automated docking sequences. In contrast, traditional ROVs and/or docking systems utilize a camera mounted on the ROV frame itself and do not provide a clear and/or as accurate a position of the docking procedure as is necessary. Rotary system 500 described in FIG. 5A may be substantially similar to the device illustrated in FIGS. 3B and 4B.

FIG. 5B illustrates one embodiment of a docking receptacle for the docking probe of FIG. 5A. Docking receptacle 550 may comprise mounting frame 559 that may be bolted and/or attached to a portion of the subsea transfer device, such as node transfer device 101 or other subsea basket, skid, etc. In some embodiments, a plurality of docking receptacles may be utilized on a single subsea transfer device. In one embodiment, docking receptacle 453 (see FIG. 4B) may be substantially similar to docking receptacle 550. Docking receptacle 551 may comprise opening 553 into which an end of the docking probe (such as nose 517) may be inserted. Docking pin 551 may be located within the docking receptacle opening and may receive opening 515 of probe nose 517. On either side of opening 515 may comprise a plurality of plates 554 to facilitate coupling of the probe to the docking pin. In some embodiments, a plurality of secondary docking guides 557*a*-557*d* may be located on exterior portions of the docking receptacle 550. Those docking guides may provide additional stability and/or docking capabilities between the ROV and the subsea device.

In operation, to couple the probe of FIG. 5A with the docking receptacle of FIG. 5B, probe 511 is moved towards docking receptacle 550. Signals from camera 531 and/or sensors 533 may facilitate positioning and/or guidance of the probe. The nose 517 of the probe is moved and inserted into opening 553 of docking receptacle 550 and around docking pin 551. Once in position, latch 521 is actuated to close and/or lock around docking pin 551. The docking probe can be rotated as further described in relation to FIGS. 6A-6C to decrease the distance between the subsea device and the ROV. Once the payload devices (e.g., seismic nodes) have been transferred from the subsea device to the ROV as illustrated in FIGS. 7A-7D, latch 521 is unlocked/released and the probe is removed from the docking receptacle by moving the ROV away from the transfer device.

Figure 5C:
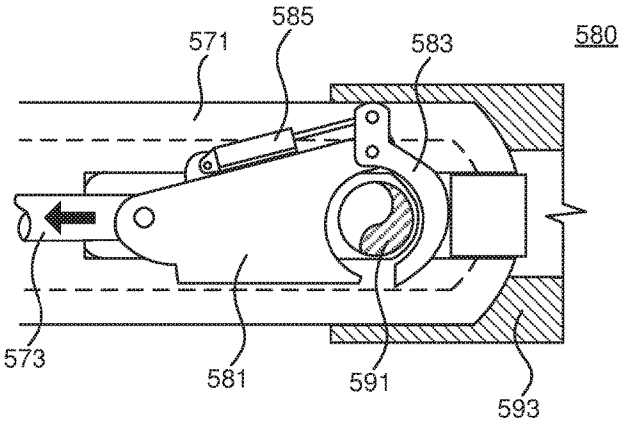
FIG. 5C illustrates one embodiment of a hydraulic latch for a docking probe.

FIG. 5C illustrates one embodiment of a hydraulic latch for a docking probe. In one embodiment, latch system 521 of FIG. 5A may be similar to the latching system of FIG. 5C. In one embodiment, the docking probe may be substantially fixed in length, while in other embodiments it may be linearly extendable. Similarly, in one embodiment a latching system within the probe may be substantially fixed in length (such as that described in relation to FIG. 5A) while in other embodiments the latching system may linearly extend (such as that described in relation to FIG. 5C). In one embodiment, latching system 580 comprises arm 581 coupled to hydraulic latch 583, which together may form a closed or locked position around pin 591 (which may be similar to pin 551) on a separate device 593, such as a seismic node transfer device. Latch 583 is moveable between a first, locked position (e.g., a closed position) and second, unlocked position (e.g., an open position) by actuation of hydraulic cylinder 585. The latch assembly may be linearly extendable by actuation of hydraulic cylinder 573. In one embodiment, cylinder 573 is actuated to push or pull the subsea device relative to the ROV after the latch is closed around pin 591. In other embodiments, cylinder 573 is actuated to position the latch for locking around the pin. For example, at a certain distance before the latching mechanism engages pin 591, the latching mechanism may be extended towards the docking pin by actuation of hydraulic cylinder 573. In one embodiment, the latch is in an opened or retracted position and once the latch is adjacent to the pin, hydraulic cylinder 585 may be actuated to close the latching mechanism 583 around pin 591. Once the latch is locked and/or securely attached to pin 591, the hydraulic cylinder 573 may be retracted thereby retracting the latching mechanism and coupled node transfer device closer towards the ROV. In other embodiments, once the latch is locked round pin 591, the hydraulic cylinder is rotated by rotation of a rotary actuary and/or docking probe assembly, similar to that described in relation to FIG. 5A.

FIGS. 6A-6C illustrate operational steps for docking a ROV to a subsea device using a rotary docking probe according to one embodiment of the present disclosure. A partial view of ROV 111 is illustrated, which may be coupled to a node docking system 601 located on a rear or front position of the ROV. The ROV may also have a skid (not shown) located substantially on the lower side of the ROV and/or which may be partially coupled to the node docking system 601. Node docking system 601 may comprise an elevator mechanism 603 that may move up and down the node docking system during handling of the nodes. Node docking system 601 may also comprise docking probe 613 that may be coupled to rotary actuator 611. Similar to prior figures, the docking probe may rotate between different positions based on actuation of rotator 611.

FIG. 6A shows the docking probe in a first, retracted position that is substantially vertical. This position may be used when the ROV is travelling between different subsea positions. In some embodiments, the retracted position may have the probe pointed downward or backward instead of substantially up/vertical. FIG. 6B shows the docking probe in a second, extended position that is substantially horizontal. This position may be used when the ROV is docking with a subsea transfer device 621, such as a subsea basket that is configured to hold a plurality of seismic nodes 2. As illustrated, docking probe 613 is coupled with docking receptacle 623 on the subsea transfer device 621. Rotary actuator 611 is actuated to rotate the docking probe between the first position shown in FIG. 6A to the second position shown in FIG. 6B. In some embodiments, a portion of the docking probe may be linearly extended to further dock and/or mate docking probe 613 to the docking receptacle. FIG. 6C shows the docking probe in a partially retracted position while still coupled to the docking receptacle of device 621. This position may be used to relatively bring node transfer device 621 and ROV 111 closer together in a horizontal and/or vertical position. In one embodiment, rotation of the docking probe rotates the subsea device 621 horizontally closer to the ROV and vertically upwards relative to the ROV in a single rotary motion (which itself may be continuous or staged rotation). As shown in FIG. 6C, such a close position allows elevator mechanism 603 to more easily travel to and hold onto node 2. In some embodiments, the elevator mechanism 603 may be coupled to a grabber or attachment mechanism as illustrated in prior figures. In one embodiment, the connection between docking probe 613 and docking receptacle 623 is loose and/or allows the subsea device to remain at a substantially horizontal level between a first, vertical position (as shown in FIG. 6B) and a second, vertical position (as shown in FIG. 6C). For example, the docking receptacle may comprise a pin or bar over which a loose-fitting latch may be secured, thereby allowing the clamp/docking probe to freely rotate about the latching pin.

FIGS. 7A-7D illustrate operational steps for transferring a seismic node from a subsea basket to a ROV according to one embodiment of the present disclosure. A partial view of ROV 111 is illustrated, which may be coupled to a node docking system 701 located on a rear or front position of the ROV. ROV 111 may also have a skid 115 located substantially on the lower side of the ROV and/or which may be partially coupled to the node docking system 701. Node docking system 701 may comprise an elevator mechanism 703 that may move up and down the node docking system during handling of the nodes. A node handler (not shown) may also be attached to elevator mechanism which physically couples (for handling and transfer purposes) to an individual seismic node. Node docking system 701 may also comprise a rotatable docking probe as described in prior figures, such as FIGS. 6A-6C. While FIGS. 6A-6C show one embodiment on how a ROV may dock with a subsea transfer device using the disclosed rotary docking probe, FIGS. 7A-7D illustrate one embodiment of transferring seismic nodes from the subsea transfer device to the ROV after docking has occurred and after the node transfer device has been physically positioned closer to the ROV as illustrated in FIGS. 6A-6C. However, in one embodiment, the disclosed elevator mechanism and transfer steps can be used with docking probes that are not rotated, such as docking probes or harpoons that may be linearly extended or simply have a fixed length. Thus, the disclosed device and steps described in relation to FIGS. 7A-7D are not limited to a rotating docking probe.

Figure 7A:
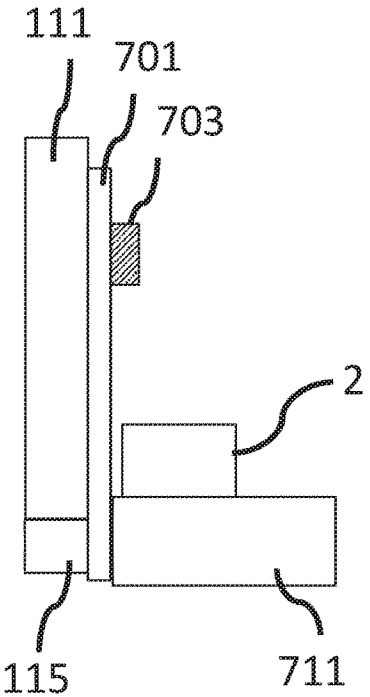
FIGS. 7A-7D illustrate operational steps for transferring a seismic node from a subsea basket to a ROV according to one embodiment of the present disclosure.
Figure 7B:
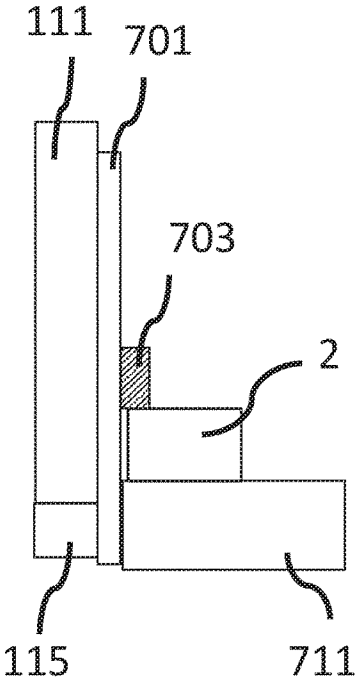
Figure 7C:
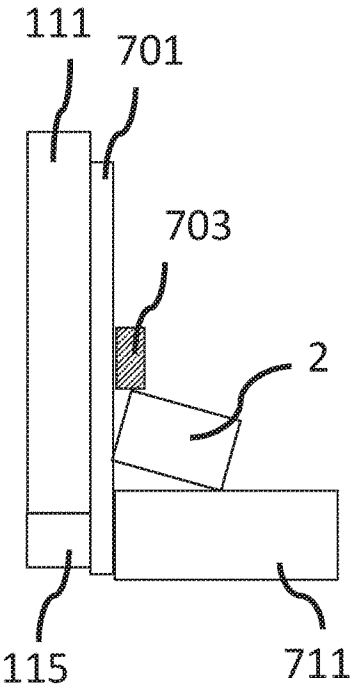
Figure 7D:
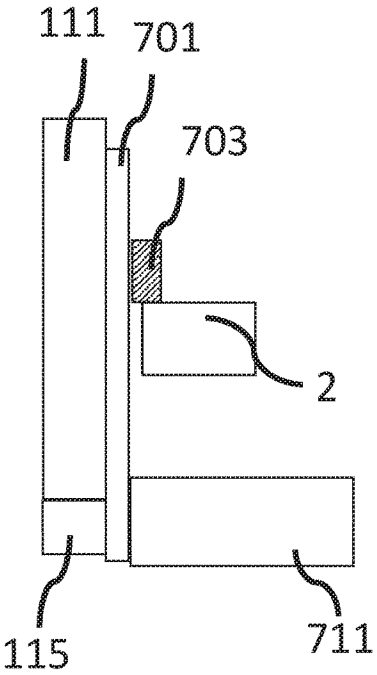

Referring to FIG. 7A, ROV 111 may approach node transfer device 711 and docking system 701 may mate or couple with the node transfer device via a variety of mating, docking, or latching mechanisms (see, e.g., FIGS. 2-6). FIG. 7A shows the ROV and transfer device position after docking has occurred and after the node transfer device has been physically positioned closer to the ROV, such as illustrated in FIGS. 6A-6C. While seismic node 2 is shown on an upper surface of transfer device 711, additional nodes may be located on or within node transfer device 711. Elevator mechanism 703 is shown in a first, upper vertical position. When the node transfer device is at a predetermined distance from the ROV, elevator mechanism 703 (along with the coupled node grabber, if present) is positioned (both vertically and horizontally) to grab and/or hold a seismic node 2 that is located on the node transfer device. For example, as shown in FIG. 7B, elevator mechanism 703 may be moved to a second, lower vertical position that is more proximate to node 2. In one embodiment, elevator mechanism 703, or a portion thereof, such as a node handler or grabber coupled to the elevator, may be positioned to mate with and/or grab one or more of the seismic nodes on the node transfer device. In one embodiment, the node transfer device may be a forklift or other mechanism that lifts the nodes off the node transfer device. In other embodiments, the node handling device may be a node latching/grabbing system that couples to a portion of the node for handling and transfer. As shown in FIG. 7C, once the node grabber is secured to a portion of the node, the elevator mechanism may be moved vertically to raise the node at least partially off of (or from) the node transfer device 711. In some embodiments, the raising mechanism may tilt or rotate the node during lift off of the node. For example, a portion of the node transfer device may be rotated after grabbing the node so as to rotate the node partially off the transfer device. As shown in FIG. 7D, the elevator mechanism is moved further vertically to further raise the seismic node off of the node transfer device until it is fully raised off and/or detached from the node transfer device. As shown in FIG. 7D, the seismic node is fully raised off of the node transfer device and the ROV is ready to disengage from the basket and travel to another subsea positioned with the attached node(s). In some embodiments, a plurality of nodes may be transferred to and/or handled by the ROV at the same time or sequentially during a single docking procedure. For example, the nodes may be placed on top of each other on the docking system or even handled side-by-side by the ROV. Further, more than one node grabber may be used on the docking system.

Figure 8:
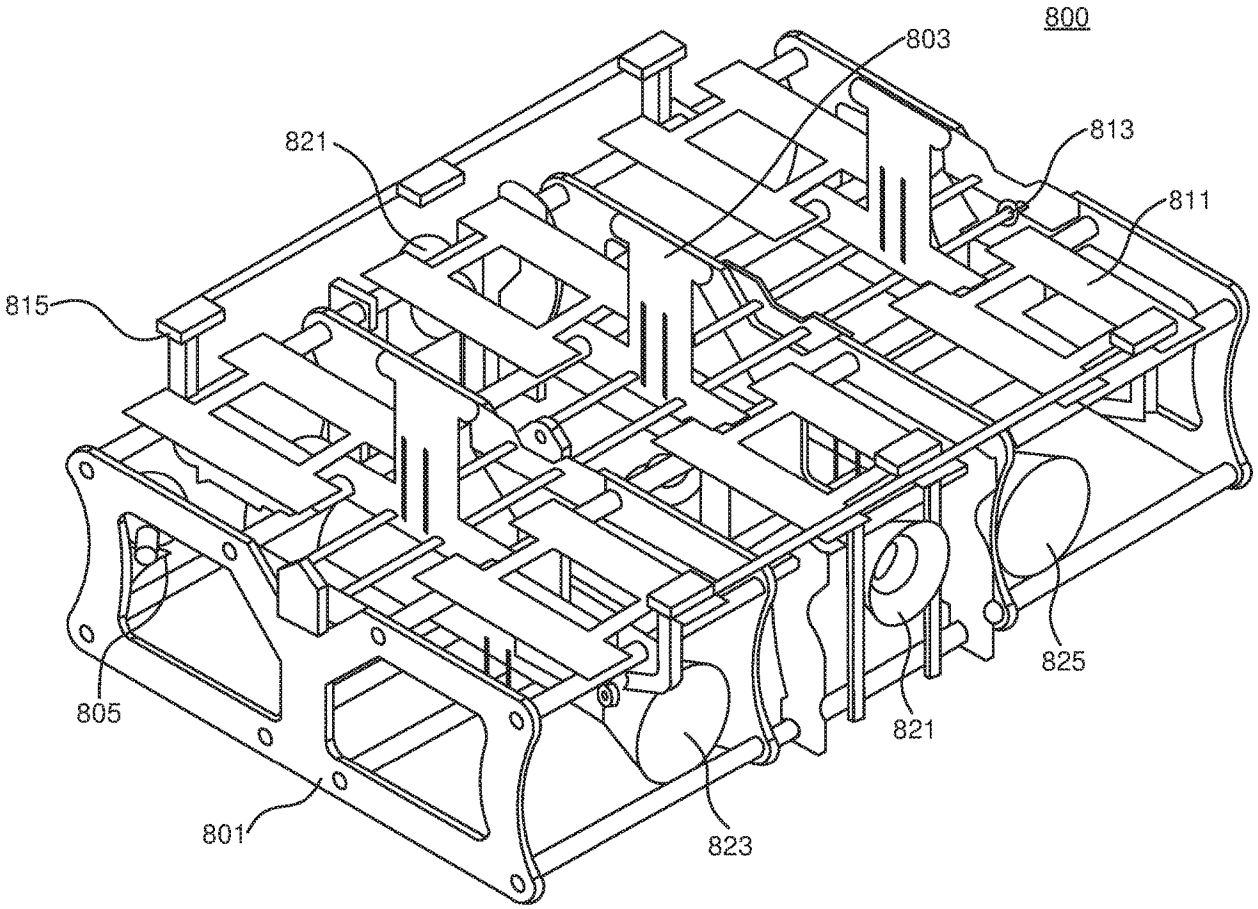
FIG. 8 illustrates one embodiment of an underwater node transfer device.

FIG. 8 illustrates one embodiment of a subsea transfer device, such as a subsea basket or cage. In one embodiment, it is configured as a seismic node transfer device and may carry a plurality of autonomous ocean bottom seismic nodes. Node transfer device 800 may be in the form of a skid, basket, cage, or other subsea device capable of holding a plurality of seismic nodes during transfer from a surface vessel to a subsea position or the seabed. Node transfer device 800 may have a plurality of levels of nodes or just a single level of nodes (as shown in FIG. 8). The node transfer device disclosed in FIG. 8 is effectively a skid or open body frame 801 with individual seats or platforms 811 upon which an individual seismic node may be placed. The node transfer device shown in FIG. 8 is capable of holding approximately six autonomous nodes at a single time. More or less seismic nodes may be handled based on the size and shape of the nodes and transfer device. In one embodiment, the node transfer device has one or more latching mechanisms (not shown) configured to hold each of the plurality of seismic nodes to the transfer device. In one embodiment, each seat 811 has a corresponding latching mechanism that can be selectively actuated to release the individual node from node transfer device 800. In other embodiments, a row of the nodes can be released/unlocked at the same time by a common release mechanism 815. In some embodiments, a rotatable bar or release mechanism 813 may be coupled to a plurality of seismic node latching systems and be actuated to unlock and/or release one or more of the seismic nodes from the transfer device. Node transfer device 800 may also have one or more holding mechanisms 803 that may be coupled to a cable that is connected to a surface vessel.

Node transfer device 800 may comprise one or more docking receptacles 821 located on various portions of frame 801 for mating with a docking and/or alignment probe on the ROV. In one embodiment, receptacle 821 may be an open collar or cone for receiving a substantially cylindrical device, while in other embodiments it may be a rectangular open-faced frame with a latching pin (such as that described in relation to FIG. 5B). Node transfer device 800 may comprise a plurality of thrusters 805 that are acoustically actuated by the ROV to twist or hold the node transfer device substantially in the same subsea position during docking. Each thruster may be coupled to a battery source for power, so that the deployment line connecting the basket to the surface vessel need not contain power and/or data. In other embodiments, the thrusters are used to rotate the node transfer device into better alignment with the ROV before or after the ROV docking probe has mated with docking receptacle 821 on the node transfer device. In one embodiment, node transfer device 800 may comprise a plurality of venturi tubes 823, 825 that are used to help balance the node transfer device during subsea operations and subsea travel both horizontally and vertically while attached to a deployment line with the surface vessel. The underwater vehicle (ROV) and the node transfer device may each have acoustic modems that are configured to acoustically communicate with each other as may be necessary during coupling between the two devices or transfer of nodes between the two devices.

Figure 9A:
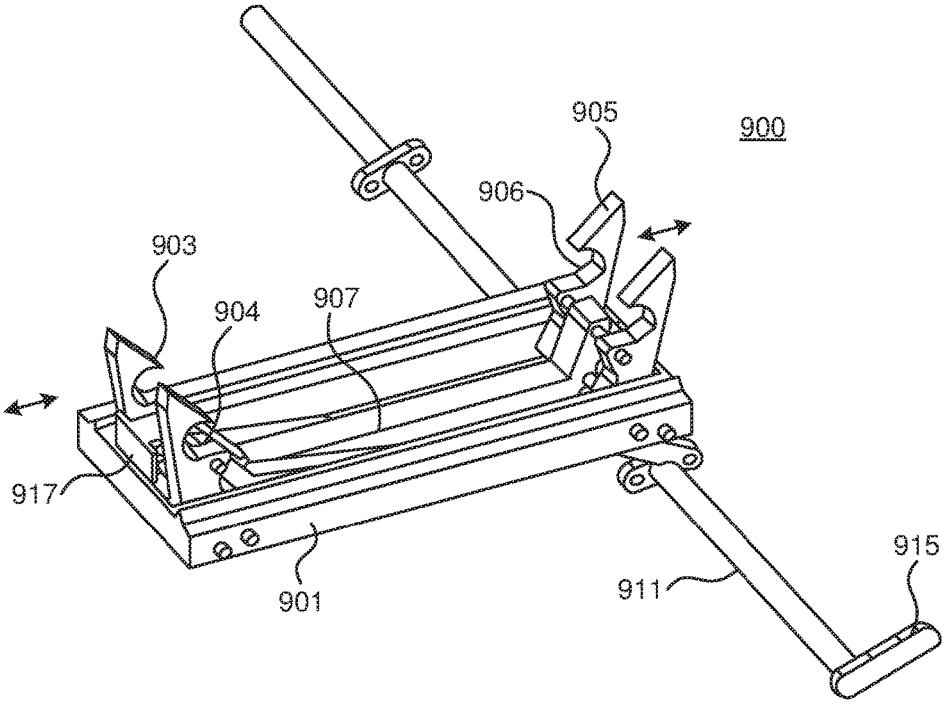
FIG. 9A illustrates a seismic node latching mechanism that can be used with node transfer device of FIG. 8.
Figure 9B:
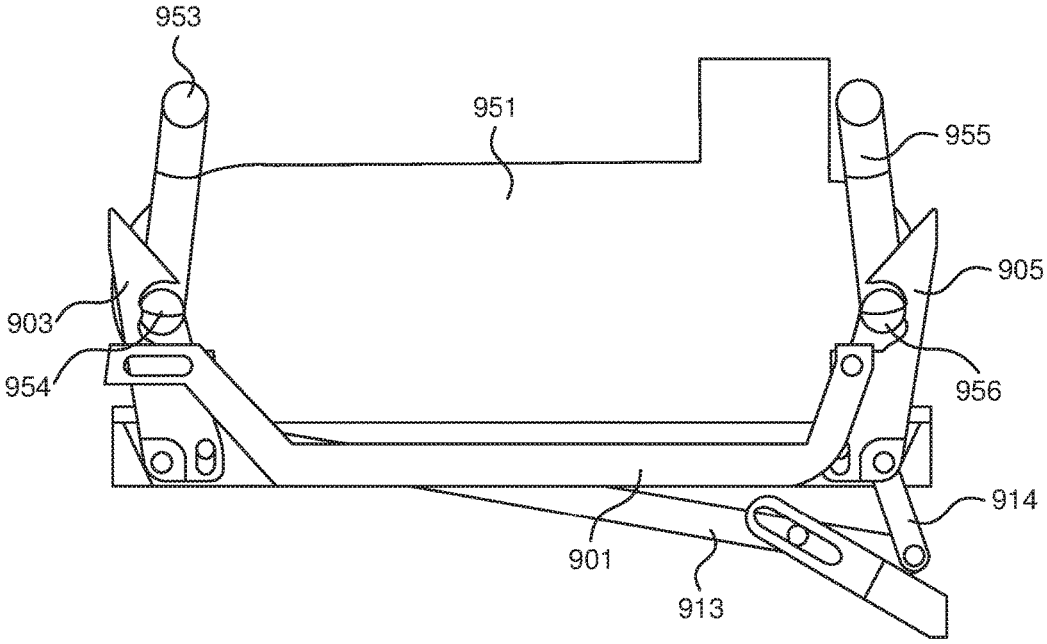
FIG. 9B illustrates a seismic node secured within the seismic node latching mechanism of FIG. 9A.

FIGS. 9A and 9B illustrate various views of a node latching mechanism that may be used with the node transfer device of FIG. 8. In particular, FIG. 9A illustrates a seismic node latching mechanism that can be used with node transfer device 800 of FIG. 8, while FIG. 9B illustrates a seismic node secured within the seismic node latching mechanism of FIG. 9A.

FIG. 9A illustrates one embodiment of node latching mechanism 900, which may comprise latch base 901 upon which a seismic node 951 may sit upon (see FIG. 9B). The latch mechanism may be coupled to rod 911 that may be coupled to other latching mechanisms for other seismic nodes. In one embodiment, the rotation of rod 911 actuates the latch mechanism from an unlocked position to a locked position (and vice versa). In one embodiment, lever 915 may be actuated to rotate rod 911, while in another embodiment push lever 917 may be actuated to rotate rod 911. In one embodiment, the latching assembly 900 comprises one or more latches 903 located on a first side of the latching assembly and one or more latches 905 located on a second, opposite side of the latching assembly. Latches 903, 905 may also be coupled to each other via at least linking mechanism 907. Each latch 903, 905 may have an opening 904, 906, respectively, that is configured to couple with and/or secure to a portion of the seismic node (as illustrated in FIG. 9B).

As shown in FIG. 9B, rod 911 is coupled to first latch mechanism 903 by first arm linkage 913 and second latch mechanism 905 by second arm linkage 914. Seismic node 951 may have a first handle 953 with arm 954 and a second handle 955 with arm 956. In one embodiment, opening 904 of the first latch mechanism is configured to couple with arm 954 and opening 906 of the second latch mechanism is configured to couple with arm 956. Different latch mechanisms can be configured for different sizes and shapes of the node. Thus, locking assembly 900 may be actuated at multiple points within the system by the ROV to unlock (or lock, if transferring nodes to the node transfer device) one or more seismic nodes from the node transfer device.

All of the systems and methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Many other variations in the configurations of the docking system and method are within the scope of the invention. For example, in some embodiments, only one node is transferred from the node transfer device at a time, while in other embodiments multiple nodes may be removed from the node transfer device at substantially the same time. In some embodiments, a retractable docking probe is used, while in other embodiments a fixed length rotatable docking probe may be used. Further, the disclosed rotatable docking probe is not limited to ocean bottom seismic nodes, and a wide variety of payload devices may be transferred between two subsea structures utilizing the disclosed rotatable docking probe. As another example, the ROV may use an elevator mechanism (with or without node grabbers) whether or not a rotary docking probe is utilized, and vice versa. As another example, the underwater vehicle may be any unmanned underwater vehicle (UUV), autonomous underwater vehicle (AUV), remotely operated vehicle (ROV), or even a manned submersible. As still another example, the ROV may dock to any subsea structure, whether stationary or moving, such as subsea equipment located on or near the ocean floor, a subsea vessel, subsea equipment located anywhere between the surface and the seabed, and a lowerable basket or skid. It is emphasized that the foregoing embodiments are only examples of the very many different structural and material configurations that are possible within the scope of the present invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. A subsea docking apparatus, comprising a rotatable docking probe located on an underwater vehicle that is configured to couple with a docking receptacle located on a second subsea device, wherein the rotatable docking probe comprises a latching system for coupling with the docking receptacle, wherein the rotatable docking probe comprises a retractable hydraulic cylinder for actuating the latching system.

2. The apparatus of claim 1, wherein the rotatable docking probe is coupled to a rotary actuator.

3. The apparatus of claim 1, wherein the rotatable docking probe comprises a tapered end and a slotted groove for coupling with the docking receptacle.

4. The apparatus of claim 1, wherein the rotatable docking probe is configured to move between a retracted position and an extended position by rotation of the docking probe.

5. The apparatus of claim 4, wherein the retracted position is substantially upright and the extended position is substantially horizontal.

6. The apparatus of claim 1, wherein a distance between the underwater vehicle and the second subsea device is changeable based on a rotation of the docking probe after the docking receptacle and docking probe have coupled.

7. The apparatus of claim 1, further comprising a camera located in an eye of the docking probe.

8. A subsea docking system, comprising a rotatable docking probe located on a first subsea device; and a docking receptacle located on a second subsea device that is configured to couple with the rotatable docking probe, wherein a distance between the first subsea device and the second subsea device is changeable based on a rotation of the docking probe after the docking receptacle and docking probe have coupled, wherein the first subsea device is an underwater vehicle and the second subsea device is a node transfer device configured to hold a plurality of seismic nodes.

9. The system of claim 8, wherein the docking receptacle comprises a latching pin and the rotatable docking probe comprises a latching system that attaches to the latching pin.

10. The system of claim 8, further comprising a plurality of secondary alignment guides on the first subsea device or the second subsea device to facilitate coupling of the first and second subsea devices.

11. A subsea docking system, comprising a rotatable docking probe located on a first subsea device; and a docking receptacle located on a second subsea device that is configured to couple with the rotatable docking probe, wherein a distance between the first subsea device and the second subsea device is changeable based on a rotation of the docking probe after the docking receptacle and docking probe have coupled, wherein the docking receptacle comprises a latching pin and the rotatable docking probe comprises a latching system that attaches to the latching pin.

12. The system of claim 8, further comprising an elevator mechanism located on the underwater vehicle that is configured to move between a plurality of vertical positions, wherein one or more node handlers is coupled to the elevator mechanism.

13. A method for subsea docking, comprising coupling an underwater vehicle to a subsea structure with a docking probe;

rotating the docking probe to move the subsea structure relative to the underwater vehicle; and transferring a plurality of payload devices between the subsea structure and the underwater vehicle.

14. The method of claim 13, wherein the rotating step moves the subsea structure vertically and horizontally relative to the underwater vehicle.

15. The method of claim 13, wherein the coupling step comprises rotating the docking probe from a retracted position to an extended position, and inserting the docking probe into a docking receptacle.

16. The method of claim 13, wherein the coupling step comprises latching a portion of the docking probe to a portion of a docking receptacle, wherein the docking probe is located on the underwater vehicle and the docking receptacle is located on the subsea structure.

17. The method of claim 13, wherein the transferring step comprises operating an elevator mechanism on the underwater vehicle.

18. The system of claim 11, wherein the first subsea device is an underwater vehicle and the second subsea device is a node transfer device configured to hold a plurality of seismic nodes.

* * * * *